US011298932B2

(12) United States Patent
Magnone

(10) Patent No.: US 11,298,932 B2
(45) Date of Patent: Apr. 12, 2022

(54) METHOD FOR DETERMINING THE POSITION OF MUTUAL CONTACT BETWEEN A PRINTING ROLLER AND AT LEAST ONE COUNTER ROLLER

(71) Applicant: KOENIG & BAUER AG, Würzburg (DE)

(72) Inventor: Stefano Magnone, Tortona (IT)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/435,051

(22) PCT Filed: Mar. 11, 2020

(86) PCT No.: PCT/EP2020/056513

§ 371 (c)(1),
(2) Date: Aug. 31, 2021

(87) PCT Pub. No.: WO2020/187665

PCT Pub. Date: Sep. 24, 2020

(65) Prior Publication Data

US 2022/0040966 A1 Feb. 10, 2022

(30) Foreign Application Priority Data

Mar. 19, 2019 (DE) ..... 10 2019 107 012.0
Mar. 19, 2019 (IT) ..... 102019000003965

(51) Int. Cl.
*B41F 5/24* (2006.01)
*B41F 13/004* (2006.01)
(Continued)

(52) U.S. Cl.
CPC ..... *B41F 5/24* (2013.01); *B41F 13/0045* (2013.01); *B41F 33/02* (2013.01); *B41F 13/26* (2013.01)

(58) Field of Classification Search
CPC ..... B41F 5/24; B41F 13/0045; B41F 33/02; B41F 13/26
See application file for complete search history.

(56) References Cited

U.S. PATENT DOCUMENTS

2012/0079954 A1* 4/2012 Westhof ..... B41F 13/38 101/248
2015/0082600 A1* 3/2015 Kobusch ..... B41F 31/307 29/428

FOREIGN PATENT DOCUMENTS

DE 202011052514 U1 3/2012
EP 1018426 A1 7/2000
(Continued)

OTHER PUBLICATIONS

International Search Report of PCT/EP2020/056513 dated May 15, 2020.

*Primary Examiner* — David H Banh
(74) *Attorney, Agent, or Firm* — Mattingly & Malur, PC

(57) ABSTRACT

A method is disclosed, which method is or at least can be carried out in a flexographic printing press for the purpose of determining a position of mutual contact between a printing roller and at least one counter roller. An average position of mutual contact between the printing roller and the counter roller is calculated, based on every position of mutual contact between the printing roller and the counter roller that is determined for a specific angular position of the printing roller and is used to execute a printing process carried out by the flexographic printing press.

8 Claims, 4 Drawing Sheets

(51) Int. Cl.
*B41F 33/02* (2006.01)
*B41F 13/26* (2006.01)

(56) References Cited

FOREIGN PATENT DOCUMENTS

| | | | |
|---|---|---|---|
| EP | 2460658 | B1 | 1/2019 |
| IT | VR20120085 | A1 | 11/2013 |
| WO | 2010142405 | A2 | 12/2010 |
| WO | 2010142405 | A3 | 3/2011 |
| WO | 2015001126 | A1 | 1/2015 |

* cited by examiner

METHOD FOR DETERMINING THE POSITION OF MUTUAL CONTACT BETWEEN A PRINTING ROLLER AND AT LEAST ONE COUNTER ROLLER

CROSS-REFERENCE TO RELATED APPLICATIONS

This application is the U.S. national stage, under 35 USC § 371, of PCT/EP2020/056513, filed Mar. 11, 2020; published as WO 2020/187665 A1 on Sep. 24, 2020 and claiming priority to IT 10 2019 00000 3965, filed Mar. 19, 2019, and to DE 10 2019 107 012.2, filed Mar. 19, 2019, the disclosures of which are expressly incorporated herein in their entireties by reference

FIELD OF THE INVENTION

The present invention relates to a method which is or at least can be carried out in a flexographic printing press for the purpose of determining the position of mutual contact between a printing roller and at least one counter roller. The printing roller and the at least one counter roller are arranged in a flexographic printing press. The printing roller is arranged between two counter rollers, of which one counter roller is in the form of a central drum, and the other counter roller is in the form of an inking roller. The printing roller and the counter roller each have a first electric motor and can each be moved in rotation by its respective first electric motor. Each of these first electric motors has a first encoder. At least the printing roller and the inking roller each have a second electric motor and can each be moved translationally, by its respective second electric motor, in the direction of a mutual approach between the printing roller and the counter roller. Each of these second electric motors has a second encoder. The counter roller is moved, in rotation, by its respective first electric motor, while the printing roller, which is arranged spaced from the counter roller, is left in a predetermined angular position and is not rotating. The non-rotating printing roller is moved translationally in a direction D of the counter roller, by the corresponding second electric motor. At least one non-zero value of a parameter is detected by the first encoder of the corresponding first electric motor of the printing roller. This parameter indicates an idling rotation induced by the mutual contact between the counter roller and the printing roller. The position of mutual contact between the printing roller and the counter roller, based on the value of the detected parameter, is determined.

BACKGROUND OF THE INVENTION

From EP 1 018 426 A1 a method for setting two cylinders of a printing press against one another is known, wherein one of the two cylinders is allowed to rotate while the two cylinders are moved radially toward one another and the torque acting on one of the two cylinders is monitored, and wherein, when the monitored torque exceeds a predefined threshold, the radial position of the two cylinders reached at that moment relative to one another is taken as the zero position for the setting.

From WO 2010/142405 A2, a printing press having at least one inking unit is known, which inking unit comprises at least two cylinders which are set against one another in printing operation, wherein the cylinders are rotatable by means of at least one drive, wherein sensors are provided in the printing press, with which parameters of the rotary movement of the cylinders, such as the torque or the rotational speed generated by the at least one drive, are recorded, wherein the printing press comprises positioning means, with which the at least two cylinders can be set against one another in their radial direction, wherein the printing press is operatively connected to a control unit with which the positioning means can be actuated, and wherein the control unit is configured to initiate the following process steps for setting the at least two cylinders against one another:

- bringing the at least two cylinders, which are set apart from one another, to different circumferential speeds
- using the positioning means to set the two cylinders against one another
- recording or maintaining the position of the two cylinders relative to one another when at least one parameter of the rotary movement of the at least two cylinders exceeds a threshold value.

A method for identifying the tangential position between the lateral surfaces of a printing cylinder and another printing element in rotary printing presses is known from IT VR20 120 085 A1.

From DE 20 2011 052514 U1 a flexographic printing press is known, which is equipped with multiple printing groups arranged around a central counterpressure roller on which the material to be printed is located, wherein each of said printing groups has at least one printing roller and one inking roller (integrated), which are opposite one another during printing and which can be set in rotation by means of at least one rotary drive motor, wherein the printing press is operatively connected to a control unit for the detection of one or more parameters for the rotary movement of the rollers, such as the torque, the electrical current consumed by said rotary drive motor, or the rotational speed, and wherein the printing press is equipped with force setting means, which apply linear motion to the end points of said printing roller and inking roller, in the radial direction thereof, and which integrate positioning motors.

From WO 2015/001126 A1 a method for setting two cylinders of a printing press against one another is known, wherein the cylinders are driven at different circumferential speeds, each by at least one drive, wherein at least the first cylinder is moved toward the second cylinder by means of at least one positioning device, wherein the contact position is determined, wherein the values of at least one measured variable for at least one of the two cylinders are detected by a measuring or detection device, wherein the values of the measured variable are received and the positioning device is activated by means of a control device, wherein the contact position is ascertained, wherein the first change in the value of the measured variable for the at least one cylinder in relation to an initial value of said measured variable results, and wherein the value of the angle of rotation at which the value of the measured variable differs from the initial value is recorded.

A flexographic printing press has a central drum on which a printing material in the form of a sheet or a flexible film is arranged in a printing process. One or more printing couples are brought into contact with the central drum. Each printing couple has a printing roller and an inking roller, with the printing roller bearing at least one cliche on its lateral surface. The inking roller, usually in the form of a screen roller, is also called an anilox roller.

In a flexographic printing press of the type described above, a first pair of electric motors move the printing roller of each printing couple toward the central drum or away from said drum, and a second pair of electric motors move the inking roller of each printing couple toward said printing roller or away from said printing roller. For this purpose, the axis of rotation of each printing roller or anilox roller is mounted on a guide which is orthogonal to the axis of rotation of said roller, wherein a motor is arranged at one end of each guide, and each motor effects a linear movement of the respective printing roller or anilox roller. Each of these motors is then generally associated with a detection device for detecting the angular position of the respective motor shaft, i.e. an encoder, the angular position in each case corresponding to a linear position of the printing roller and/or inking roller.

In such a flexographic printing press, there is the problem of determining the printing position of each printing roller relative to the central drum in order to guarantee an optimal pressure. The optimal pressure is characterized in that it is sufficient to produce a printed image of good print quality on the printing material but is not excessively high, since too much pressure would damage the cliches used and/or would cause a deformation of the printing areas, ultimately leading to doubled edges and the application of excessive amounts of ink. A poorly adjusted pressure level thus leads to poor ink transfer between the cliche and the printing material and/or between the ink roller and the cliche, which has a negative impact on print quality.

A similar problem also arises in determining the mutual position between the inking roller and its respective printing roller.

For solving this problem, systems for setting the positions of the printing rollers and inking rollers based on a visual assessment by an operator are known; there are also automated systems, such as the one described in European Patent No. EP 2 460 658 B1 on behalf of the same applicant.

Nevertheless, there is still a need to optimize, accelerate, and improve the automated process for determining the mutual contact position between an inking roller and its respective printing roller as well as between the printing roller and the central drum in order to determine the optimal contact pressure between these rollers during the printing process.

SUMMARY OF THE INVENTION

The object of the present invention is therefore to devise a method for determining the position of mutual contact between a printing roller and at least one counter roller.

The object is attained according to the invention by the provision of a method having the following steps. The previous angular position of the printing roller is changed by a non-zero angle. The steps of moving the counter roller, and of determining the corresponding position of mutual contact between the printing roller and the counter roller for the angular position of the counter roll that was changed are determined. An average position of mutual contact between the printing roller and the counter roller is calculated on the basis of every position of mutual contact between the printing roller and the counter roller that is determined for a specific angular position of the printing roller.

The advantages to be achieved with the present invention consist, in particular, in that a position of mutual contact between a printing roller and at least one counter roller is determined automatically, quickly, and reproducibly, and preferably also based on the form or the relief of the cliche, wherein the position of mutual contact is between a printing roller or a cliche carried by it and a central drum and/or wherein the position of mutual contact is between the printing roller or the cliche carried by it and an inking roller.

The identified solution contributes to minimizing the amount of paper wasted during the process of setting the position of printing couples of the flexographic printing press and/or the time required for this setting process.

BRIEF DESCRIPTION OF THE DRAWINGS

An exemplary embodiment of the present invention is illustrated in the set of drawings and will be described in greater detail below.

The drawings show.

DESCRIPTION OF THE PREFERRED EMBODIMENT

Figure 1:
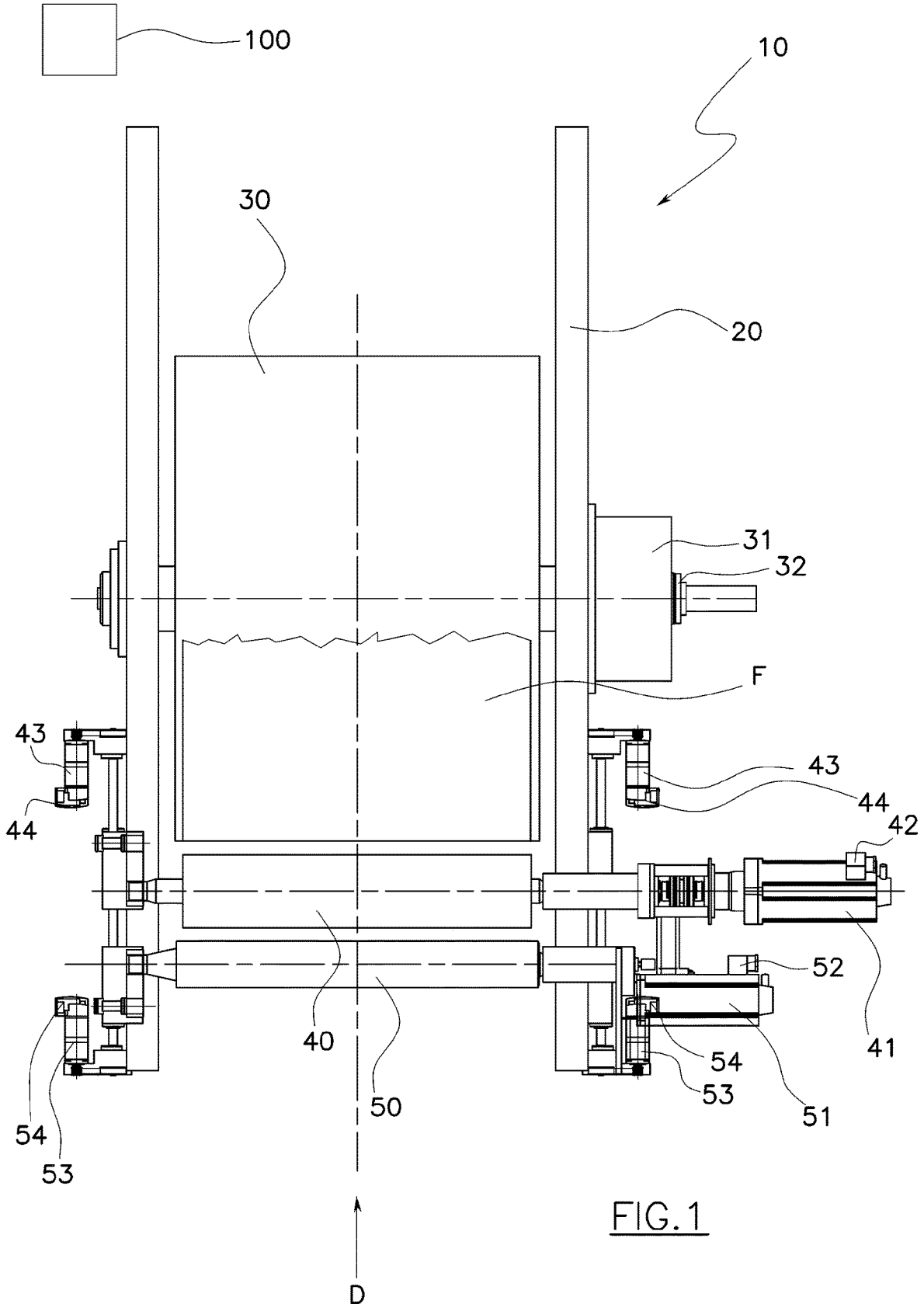
FIG. 1 a schematic plan view of a section of a flexographic printing press.

A flexographic printing press of generic type is denoted as a whole by the reference sign 10. A flexographic printing press 10 of this type has a pair of frame walls 20 arranged parallel to one another, between which a central drum 30 is rotatably mounted. In the printing process, a printing material, in particular in the form of a flexible film F, is guided at least around this central drum 30 or is supported by the rotating central drum 30 in the printing process. At least one printing roller 40 is or at least can be thrown onto this central drum 30 to apply a print image to the printing material. The printing roller 40 is arranged between two counter rollers 30; 50, of which one counter roller 30 is the central drum 30 and the other counter roller 50 is in the form of an inking roller 50. One printing roller 40 cooperating with one inking roller 50 forms a printing couple in the flexographic printing press 10. The inking roller 50 is in the form of a screen roller, for example, and is also referred to as an anilox roller.

FIG. 1 shows the aforementioned arrangement, by way of example, in a schematic plan view of a section of a flexographic printing press 10. As FIG. 1 further shows, the printing roller 40 and the relevant counter rollers 30; 50 each have a first electric motor 31; 41; 51 and can be moved in rotation, each by means of its respective first electric motor 31; 41; 51. Each of these first electric motors 31; 41; 51 has a first encoder 32; 42; 52. At least the printing roller 40 and the inking roller 50 each have a second electric motor 43; 53, and the printing roller 40 and the inking roller 50 can each be moved translationally, each by means of its respective second electric motor 43; 53, in the direction D which causes a mutual approach between the printing roller 40 and the relevant counter roller 30; 50. Each of these second electric motors 43; 53 also has a second encoder 44; 54.

Figure 2:
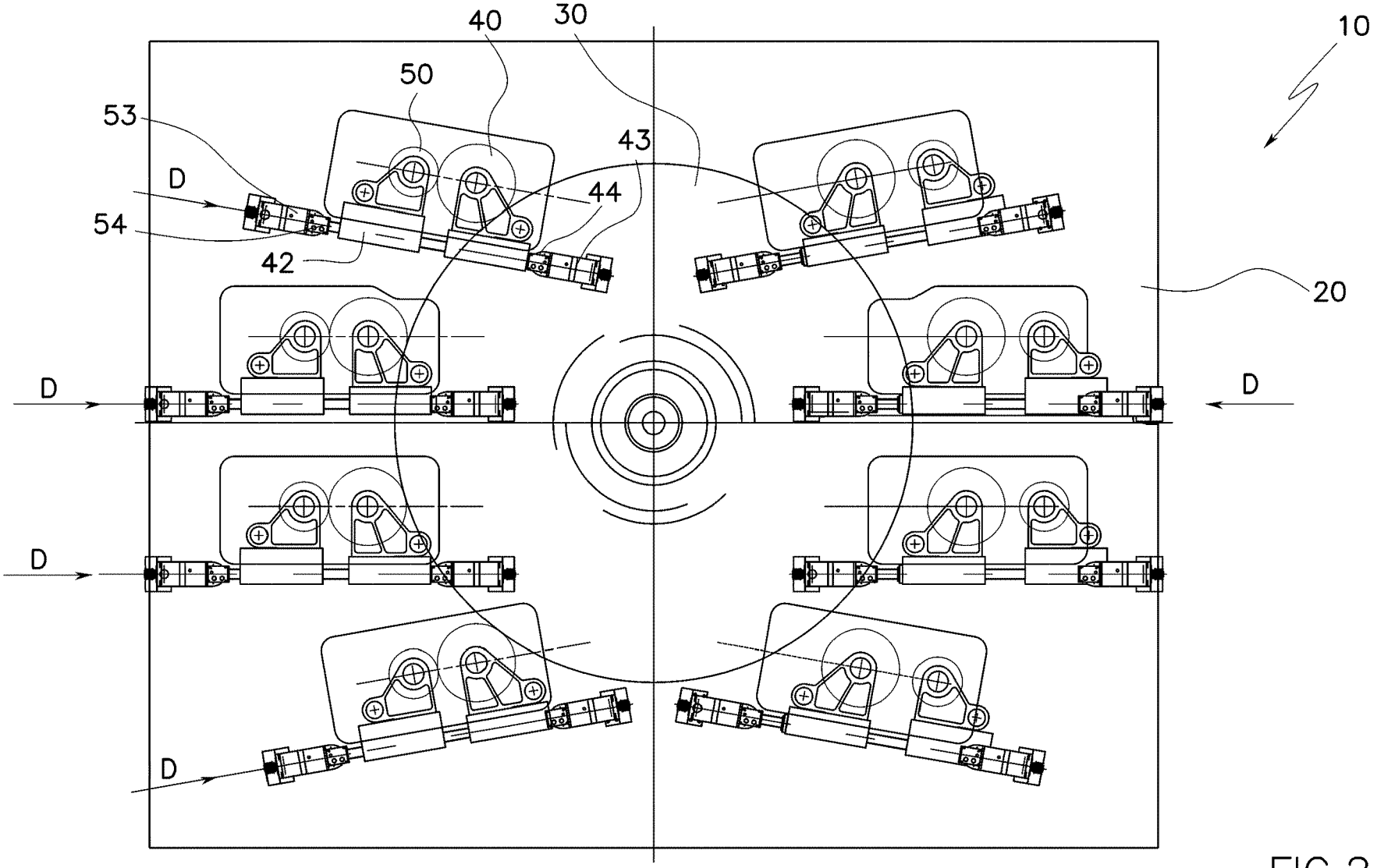
FIG. 2 a side view of the section from FIG. 1.

As is clear from FIG. 2, by way of example, which shows a side view of the section from FIG. 1, multiple, e.g. eight printing couples can be arranged around the periphery of the central drum 30, with each of these printing couples preferably being configured as described above in connection with FIG. 1. The individual printing couples can be operated independently of one another, i.e. each can be brought individually into an operative connection with the central drum 30.

According to the invention, a method for determining the position of mutual contact between a printing roller 40 and at least one counter roller 30; 50 is or at least can be carried out in this flexographic printing press 10, the method comprising the following steps:

(a) moving the counter roller 30; 50 in question in rotation by means of its respective first electric motor 31; 51 while the printing roller 40, which is arranged spaced from the counter roller 30; 50 in question, is left in a predetermined angular position and not rotating;

(b) moving the non-rotating printing roller 40 translationally in the direction D of the counter roller 30; 50 in question by means of the corresponding second electric motor 43; 53;

(c) detecting at least one non-zero value of a parameter by means of the first encoder 42 of the corresponding first electric motor 41 of the printing roller 40, said parameter indicating an idling rotation induced by the mutual contact between the counter roller 30; 50 in question and the printing roller 40;

(d) determining the position of mutual contact between the printing roller 40 and the counter roller 30; 50 in question based on the value of the detected parameter;

(e) changing the previous angular position of the printing roller 40 by an angle not equal to zero;

(f) repeating steps (a) to (d) and determining the corresponding position of mutual contact between the printing roller 40 and the counter roller 30; 50 in question for the angular position of the printing roller 40 that was changed in step (e);

(g) calculating an average position of mutual contact between the printing roller 40 and the counter roller 30; 50 in question on the basis of every position of mutual contact between the printing roller 40 and the counter roller 30; 50 in question that is determined for a specific angular position of the printing roller 40.

Each of the specific angular positions of the printing roller 40 is preferably defined on the basis of a location in the relief of a cliche which is arranged on the lateral surface of the printing roller 40.

The advantage of calculating an average position of mutual contact between the printing roller 40 and the counter roller 30; 50 in question on the basis of every position of mutual contact between the printing roller 40 and the counter roller 30; 50 in question that is determined for a specific angular position of the printing roller 40 is that by setting the position of mutual contact between the printing roller 40 and the counter roller 30; 50 in question based on this calculation, excessively high contact pressure on the printing material from the cliche arranged on the printing roller 40 and as a result, damage to the cliche used is avoided. In fact, setting an average position of mutual contact between the printing roller 40 and the counter roller 30; 50 in question leads to good print quality because undesired deformation of the printing areas is largely prevented and the creation of doubled edges and/or an excessive application of ink to the printing material is avoided.

In a further refinement of the proposed method, the determination performed in step (d) of the position of mutual contact between the printing roller 40 and the counter roller 30; 50 in question comprises the following steps:

(d1) comparing the value of the detected parameter with a previously defined range of values for that parameter;

(d2) measuring the distance traveled by the printing roller 40 or by the counter roller 30; 50 in question in its respective translational movement up to the position of mutual contact between the printing roller 40 and the counter roller 30; 50 in question, by means of the second encoder 44; 54 of the second electric motor 43; 53 that drives the relevant translational movement;

(d3) determining the position of mutual contact between the printing roller 40 and the counter roller 30; 50 in question based on the distance measured in step (d2), if the value of the detected parameter is within the previously defined value range for that parameter.

The rotational speed of the printing roller 40 at a particular angular position of the printing roller 40 is preferably selected as the parameter to be detected in accordance with step (c).

If the printing roller 40 and the counter roller 30; 50 in question, i.e. both rollers 40; 30; 50, are moved translationally each by its respective second electric motor 43; 53, then the position of mutual contact between the printing roller 40 and the counter roller 30; 50 in question is determined, preferably each independently of the other, by means of the respective second encoder 44, 54 of each second electric motor 43, 53.

The calculated position of mutual contact between the printing roller 40 and the counter roller 30; 50 in question is advantageously used in a printing process carried out by the flexographic printing press 10.

Also provided is a preferably electronic control unit 100, which is configured (FIG. 1) such that this control unit 100 defines the specific angular positions of the printing roller 40 at the respective positions of mutual contact between the printing roller 40 and the counter roller 30; 50 in question and carries out a printing process using these defined angular positions of the printing roller 40. Digital data are preferably stored in this control unit 100, in particular digital data for specific angular positions of the printing roller 40, wherein these angular positions at the respective positions of mutual contact between the printing roller 40 and the counter roller 30; 50 in question correspond to significant locations in the relief of the cliche arranged on the printing roller 40. This is because the relief of the cliche arranged on the printing roller 40 has protrusions or depressions at certain locations which are considered to be significant, depending on the printed image to be produced.

A flexographic printing press 10 therefore also results, which comprises at least one printing roller 40 arranged between two counter rollers 30; 50, the one counter roller 30 being in the form of a central drum 30 and the other counter roller 50 being in the form of an inking roller 50, wherein the printing roller 40 and the counter roller 30; 50 in question each have a first electric motor 31; 41; 51 and can be moved in rotation, each by means of its respective first electric motor 31; 41; 51, wherein each of these first electric motors 31; 41; 51 has a first encoder 32; 42; 52, wherein at least the printing roller 40 and the inking roller 50 each have a second electric motor 43; 53 and can be moved translationally, each by means of its respective second electric motor 43; 53, in the direction D of a mutual approach between the printing roller 40 and the counter roller 30; 50 in question, wherein each of these second electric motors 43; 53 has a second encoder 44; 54, and wherein this flexographic printing press 10 is configured to carry out the steps of the method described above.

Figure 3:
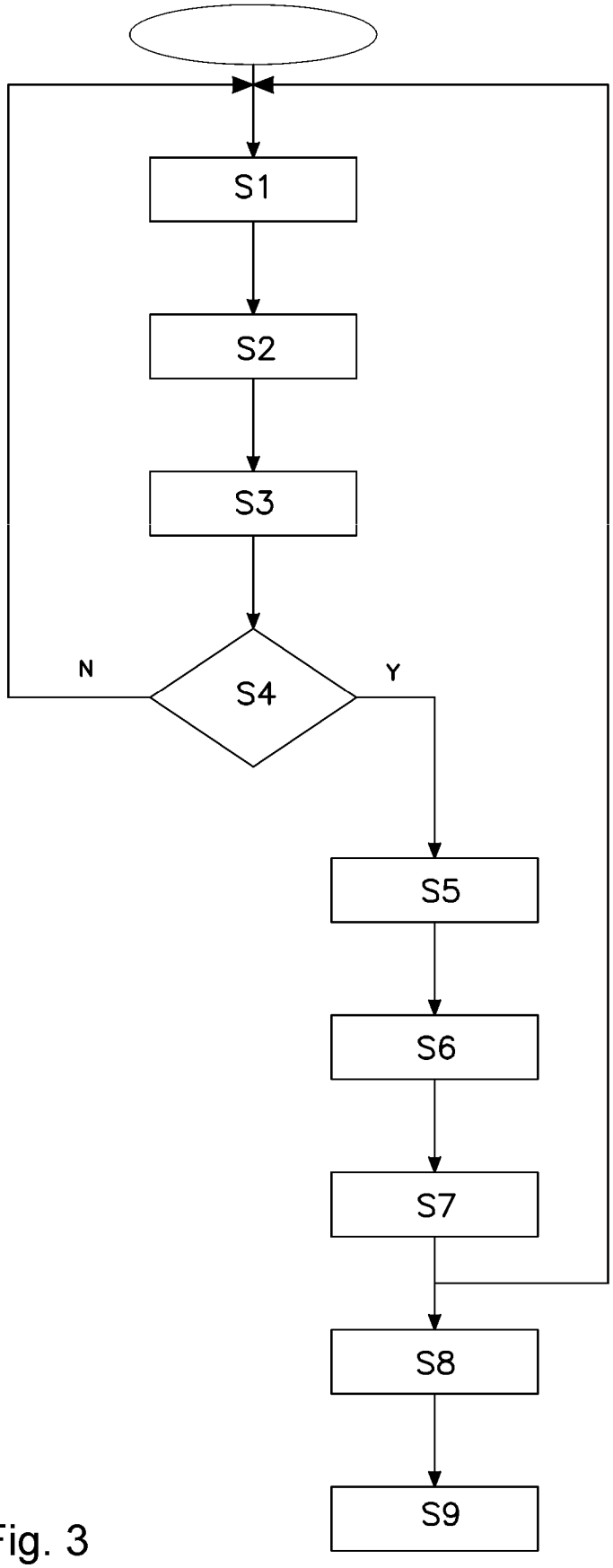
FIG. 3 a flow chart concerning the method for determining the position of mutual contact between a printing roller and a central drum in a flexographic printing press.

The method carried out in a flexographic printing press 10 to determine the position of mutual contact between a printing roller 40 and a central drum 30 will now be explained again with the aid of a flow chart provided in FIG. 3.

To begin with, the printing roller 40 is moved by means of the second electric motor 43 into its starting position.

At this point in time, the flexographic printing press 10 is driven at a minimal drive speed for transporting the flexible film F. The printing roller 40 is driven in slow rotation by its first electric motor 41, so that the printing roller 40 is arranged in accordance with a (first) predetermined (absolute) angular position. When the printing roller 40 is positioned in the first predefined angular position, the printing roller 40 is stopped, i.e. is held in place in this first angular position by the first electric motor 41, which remains in the "torque shut-off" mode, i.e. in the neutral position. The predefined angular position of the printing roller 40 may be selected as desired, e.g. by dividing the lateral surface of the printing roller 40 (i.e. the cliche arranged thereon) into sectors (equivalent sectors, for example), with the number of sectors (subject to a specified angle of rotation) being equal to the number of angular positions to be tested for each printing roller 40.

Alternatively, the predefined angular position of the printing roller 40 may be selected on a weighted basis. In that case, each angular position and/or its first angular position is predefined based on the conformity of the printing roller 40, more particularly based on a measured angular position of the relief of the cliche arranged on the printing roller 40.

Each cliche is assigned a print master, i.e. a pdf file or a jpeg file, in which the angular positions of the relief are defined precisely within a particular reference system, thereby defining the print image which is to be transferred to the flexible film F during printing.

Each predefined angular position of the printing roller 40 can be selected from the angular positions in which at least one relief or one group of reliefs is present in the cliche arranged on the printing roller 40.

More particularly, each predefined angular position is selected such that it aligns the aforementioned angular position (i.e. the selected reliefs) relative to the central drum 30 or on a plane that contains the D direction, i.e. the axes of rotation of the central drum 30 and the printing roller 40.

In any case, each predefined angular position is stored in the aforementioned memory unit.

Once the printing roller 40 has been stopped in the first predefined angular position, the central drum 30 is set in rotation by its first electric motor 31 (block S1), e.g. at a predefined (fixed) speed.

While the central drum 30 is rotating and the printing roller 40 is stationary, i.e. is not rotating, in this method the printing roller 40 is moved in the D direction toward the central drum 30 (block S2).

In practice, the method consists in activating one of the two second electric motors 43 individually in order to move the respective axial end of the printing roller 40 in the direction of the central drum 30. However, it is also possible for the two second electric motors 43 to be activated simultaneously in order to move both axial ends of the printing roller 40 forward toward the central drum 30.

The method therefore includes monitoring, by means of the first encoder 42, the rotation of the printing roller 40 (and thus of the rotor of the first electric motor 41 in its neutral position) that may be induced by contact between the rotating central drum 30 and the printing roller 40 (i.e. the cliche arranged thereon).

In particular, the method involves detecting, by means of the first encoder 42 of the first electric motor 41 of the idle printing roller 40 (in the "torque deactivated" mode), at least one non-zero value of a parameter that indicates an idling rotation (S3 block), the idling rotation being induced by the mutual contact achieved between the rotating central drum 30 and the printing roller 40 during the movement of the printing roller 40 in the D direction toward the central drum 30.

In practice, it has been observed that when the printing roller 40 is idle (i.e. not rotating), i.e. one of the reliefs on the cliche, as it is moved forward in the D direction toward the central drum 30 it will touch the central rotating drum 30 and will be carried along in rotation (in the opposite direction) by the central drum as a result of friction.

The first encoder 42 of the first electric motor 41 of the printing roller 40 detects the angular momentum imparted by the central drum 30 to the printing roller 40, for example by detecting the value of a parameter which was selected from a rotational speed of the printing roller 40 (i.e. a variation in the rotational speed of the printing roller 40 from a zero value to a non-zero value) and/or an angular position of the printing roller 40 (i.e. a variation in the angular position of the printing roller relative to the predefined—former—angular position in which the printing roller 40 was positioned).

Specifically: If the first encoder 42 of the first electric motor 41 (on the left in the "torque shut-off mode") detects a value for the rotational speed of the printing roller 40 which is not equal to zero and/or a value for the angular position of the printing roller 40 which is different from the predefined (first) angular position in which the printing roller 40 was positioned, then the electronic control unit 100 is configured to ascertain that the printing roller 40 has received drive rotation induced by the mutual contact between the printing roller 40 and the central drum 30.

The method consists in particular in comparing the value for the established parameter with a reference range for the same (block S4), e.g. with a minimum value (e.g. corresponding to a value close to an angular velocity of zero or close to the predefined angular position in which the printing roller 40 was positioned) and a maximum permissible value.

If the value for the parameter is within the reference range, then the detection can be deemed acceptable.

Otherwise, the detection is deemed unacceptable and the steps of the above method are repeated.

At this point, when the detection can be deemed acceptable, the method is continued by halting (block S5), e.g. by immediately halting the movement of the printing roller 40 in its approach to the central drum 30 in the direction D, i.e. the second, previously driven electric motor 41 is immediately stopped.

In practice, the forward movement of the printing roller 40 in the D direction toward the central drum 30 is itself halted in a (current) mutual (first) contact position with the central drum 30, i.e. at the point where the reliefs of the cliche applied to said printing roller 40 touch the central drum 30 with an optimal contact pressure, which is defined by the particular contact pressure at which the rotational movement (by friction/resistance) is transferred between the central drum 30 and the printing roller 40.

Through experimentation it has been established that this position of mutual contact, which determines the first rotation caused by the drawing of the printing roller 40 by the rotation forced by the central drum 30, determines the optimal pressure of mutual contact that will lead to optimal and high quality printing during normal operation of the flexographic printing press 10.

When the printing roller 40 is itself halted on its way to the central drum 30 in direction D in the said (current) position of mutual contact with the central drum 30, then the method consists in measuring, by means of the second encoder 44 of the second electric motor 43 of the printing roller 40, the linear (absolute) position of the printing roller 40 or of the respective axial end of the printing roller 40 in the D direction and/or the linear path which the printing roller 40 (or the respective axial end of the printing roller 40) has traveled in the D direction from the starting position (and thus from the zero position) to the aforementioned position of mutual contact (block S6).

This measurement is then identified or designated as the first mutual contact position between the printing roller 40 and the central drum 30 of the flexographic printing press 10 (block S7) and is stored as such in a memory of the control unit 100.

At this point, the above method may be repeated a number of times or n times, keeping in mind that the printing roller 40 must be rotated according to a further n−1 (and varying) predefined angular positions.

In that case, the method enables a number n of mutual contact positions for the printing roller 40 in question to be obtained, which are determined as described above.

Here again, the above method—as mentioned above—can be carried out for both axial ends of the printing roller 40, each end independently of the other. In that case, the method enables a number 2*n* of mutual contact positions to be obtained, which are determined as described above for each printing roller 40.

At this point the method is used to calculate an average mutual contact position (with the central drum 30) for each printing roller 40 on the basis of every (n or 2*n*) mutual contact position (block S8) that has been identified for every predetermined angular position of the printing roller 40, and to store this average mutual contact position in the memory of the control unit 100.

The average mutual contact position can be determined using one of the following formulas:

- simple mean value for the n trials, detected at each axial end of the printing roller.
- mean filter of the n trials detected at each axial end of the printing roller by sorting the trials in ascending order and selecting the center of the ordered series.
- mean value for the n trials detected at each axial end of the printing roller, discarding the minimum and maximum. This average mutual contact position is then used as the first approach (S9 block) in carrying out a printing operation using the flexographic printing press 10, as was described above.

Figure 4:
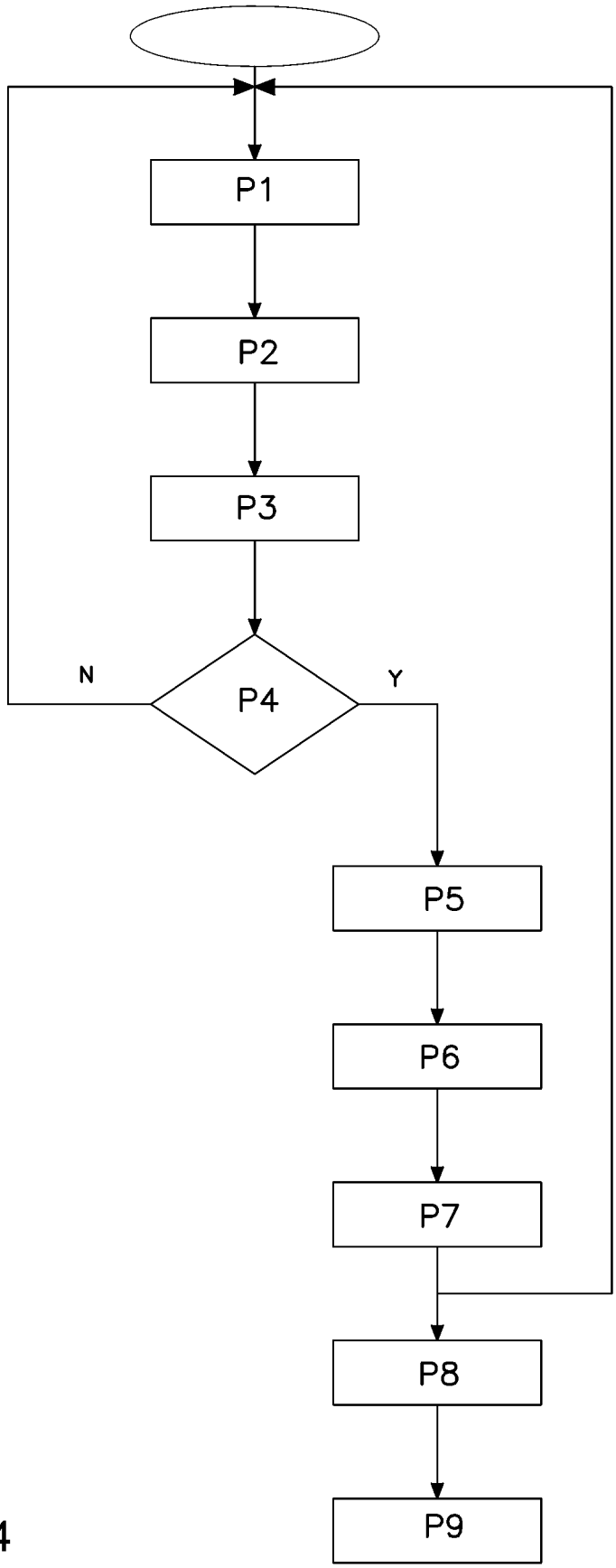
FIG. 4 a flow chart concerning the method for determining the position of mutual contact between a printing roller and an inking roller in a flexographic printing press.

Furthermore, making particular reference to FIG. 4, the procedure for determining the (correct and optimal) mutual contact position between the inking roller 50 and the printing roller 40 of each printing couple is as follows.

First, the inking roller 50 is moved into its starting position (disengaged slightly from the respective printing roller 40) by the second electric motor 53.

At this point in time, the flexographic printing press 10 is operating at a minimal drive speed (i.e. a feed rate for the film F; predefined and stored in the memory of the control unit 100).

The printing roller 40 is driven slowly in rotation by the first electric motor 41 of the same, so that it is arranged in accordance with a (first) predetermined (absolute) angular position.

When the printing roller 40 is positioned in the first predefined, selected angular position, the printing roller 40 is stopped, i.e. is held stationary in this first angular position by the first electric motor 41, which remains in the "torque shut-off" mode, i.e. in the neutral position.

The predefined angular position of the printing roller 40 may be selected randomly or on a weighted basis, as described above.

In particular, each predefined angular position is such that the angular position (i.e., the selected reliefs) is aligned with the inking roller 50 or on a plane that contains the D direction (i.e. the axes of rotation of inking roller 50 and printing roller 40).

In any case, each predefined angular position is stored in the memory of said control unit 100.

When the printing roller 40 is stationary in the first predefined angular position, the inking roller 50 is set in rotation by its first electric motor 51 (block P1), e.g. at a predefined (fixed) rotational speed.

While the inking roller 50 is rotating and the printing roller 40 is stationary, i.e. is left not rotating, the inking roller 50 is moved in the D direction toward the corresponding printing roller 40 (block P2).

In practice, this method means that the two second electric motors 53 are activated in succession to move the respective axial ends of the inking roller 50 forward to the printing roller 40.

It is also possible, however, for the two second electric motors 53 to be activated simultaneously to move the two axial ends of the inking roller 50 forward to the printing roller 40 at the same time.

Thus the method consists in monitoring, by means of the first encoder 42, every (uncontrolled) rotation imposed on the printing roller 40 (and thus on the rotor of the first electric motor 41, which is in the neutral position) by the contact between the rotating inking roller 50 and the printing roller 40 (i.e. the cliche arranged thereon).

In particular, the method involves detecting, by means of the first encoder 42 of the first electric motor 41 of the printing roller 40, which remains in the idle mode (in the "torque deactivated" mode), at least one non-zero value of a parameter of idling rotation (block P3), the idling rotation being induced by the mutual contact achieved between the rotating inking roller 50 and the printing roller 40 during the movement of the inking roller 50 in the D direction toward the printing roller 40.

In practice, it has been observed that when the printing roller 40 is idle (i.e. not rotating), i.e. with one of the reliefs on the cliche arranged on said roller, as it is moved forward in the D direction toward the inking roller 50, it will touch the inking roller 50 and will be carried along in rotation (in the opposite direction) by the inking roller as a result of friction.

The first encoder 42 of the first electric motor 41 of the printing roller 40 detects the angular momentum exerted on the printing roller 40 by the inking roller 50, e.g. by detecting the value of a parameter which was selected from between a rotational speed of the printing roller 40 (i.e. a change in the rotational speed of the printing roller 40 from a zero value to a non-zero value), and an angular position of the printing roller 40 (i.e. a change in the angular position of the printing roller 40 from the predetermined—former—angular position in which the printing roller 40 was positioned).

More specifically: If the first encoder 42 of the first electric motor 41 (on the left in the "torque deactivated" mode) has a non-zero speed value for the rotation of the printing roller 40 and/or a value for the angular position of the printing roller 40 which is different from the predefined (earlier) angular position in which the printing roller 40 was positioned, then the electronic control unit 100 is configured to ascertain that the printing roller 40 has received drive rotation induced by the mutual contact between the printing roller 40 and the inking roller 50.

The method comprises, in particular, a comparison (block P4) of the value for the established parameter with a reference range for the same, e.g. with a minimum value (e.g. corresponding to a value close to an angular velocity of zero or the predefined angular position in which the printing roller 40 was positioned) and a maximum permissible value (e.g. the same as or different from those described above).

If the value for the parameter is within the reference range, then the detection can be deemed acceptable. Otherwise, the detection is deemed unacceptable and the steps of the above-described method are repeated.

At this point, when the detection can be deemed acceptable, the method is continued by halting (block P5), e.g. by immediately halting the movement of the inking roller 50 in its approach to the printing roller 40 along the D direction, i.e. the second, previously driven electric motor 53 is immediately stopped.

In practice, the inking roller 50 is itself halted on its path toward the printing roller 40 in the D direction in a (current) mutual (first) contact position with the printing roller 40, i.e. at the point where the reliefs of the cliche applied to said printing roller 40 touch the inking roller 50 with an optimal contact pressure, which is defined by the contact pressure at which the rotational movement (by friction/resistance) is transferred between the inking roller 50 and the printing roller 40.

Experimentation has actually shown that this mutual contact position, which determines the first rotation of the printing roller 40 by the resistance of the inking roller 50, determines the optimal mutual contact pressure, which leads to an optimal, effective, precise, and efficient transfer of ink from the inking roller 50 to the reliefs of the printing roller 40 (which is reflected in high and optimal print quality) during normal operation of the flexographic printing press 10.

When the forward movement of the inking roller 50 toward the printing roller 40 in the direction D is halted in the aforementioned (current) mutual contact position, the method consists in measuring, by means of the second encoder 54 of the second electric motor 53 of the inking roller 50, the linear (absolute) position of the inking roller 50 (block P6), or the respective axial end of the inking roller 50 in the D direction or the linear distance traveled by the inking roller 50 (i.e. by the respective axial end of the inking roller 50) in the D direction from the starting position (and thus the zero position) to the aforementioned mutual contact position.

This measurement is then identified or designated as the first mutual contact position between the printing roller 40 and the inking roller 50 of the flexographic printing press 10 (block S7) and is stored as such in the memory of the control unit 100.

At this point, the above method may be repeated n times, keeping in mind that the printing roller 40 must be rotated according to the respective n−1 (and varying) predefined angular positions.

In that case, the method allows a number n of mutual contact positions for each printing couple to be obtained, which are determined as described above.

Here again, the above method—as mentioned above—can be carried out for both axial ends of the inking roller 50, each end independently of the other. In that case, the method allows a number 2*n* of mutual contact positions for each printing couple to be obtained, which are determined as described above.

At this point, the method can then calculate an average mutual contact position (between printing roller 40 and inking roller 50) for each printing couple on the basis of every (n or 2*n*) mutual contact position (block P8) that has been identified for every predetermined angular position of the printing roller 40 and can store this average mutual contact position in the memory of the control unit 100.

The average mutual contact position can be determined using one of the following formulas:

- simple average of the n trials measured for each axial end of the printing roller 40.
- median filter of the n trials detected at each axial end of the printing roller 40, in which the trials are sorted in ascending order and the center of the ordered series is selected.
- mean value of the n trials measured for each axial end of the printing roller 40, with the minimum and the maximum being discarded.

This average mutual contact position is then used as the first approach (S9 block) in carrying out a printing operation using the flexographic printing press 10, as shown below.

The printing operation consists in particular in setting the flexographic printing press 10 such that the printing roller 40 and the inking roller 50 of each printing couple of the flexographic printing press 10 are positioned in their respective established (average) mutual contact positions, and then allowing the first electric motors 31, 41 and 51 to run (at a predetermined rpm which is higher than the aforementioned driving speed) so that the flexible film F can run between the central drum 30 and the printing roller 40 (of each printing couple) to carry out printing of the same.

As is known, one or more unwinding devices can be arranged upstream of the flexographic printing press 10, on which the flexible film F to be printed is mounted in special rollers and is gradually reeled off.

Additionally, a dryer can be arranged downstream of the flexographic printing press 10, by which a flow of heat, e.g. hot air, is introduced into the printed flexible film F to dry the printing, along with a winder in which the printed and dried flexible film F is wound around a cylinder to be reeled up again.

The flexographic printing press 10 can also be equipped with drive units which support the movement of the flexible film F, and with web guide units which keep the web centered in relation to the D direction, and also with optical systems (such as monitoring cameras) for the automatic monitoring of the printing produced on the flexible film F.

The invention described above may be modified in multiple ways, these modifications and variations all falling within the scope of the inventive concept.

Furthermore, all details may be replaced with other technically equivalent elements.

In practice, the materials used and the shapes and sizes thereof may be chosen as desired according to requirements, without thereby departing from the scope of protection of the following claims.

While a preferred embodiment of a method for determining the position of mutual contact between a printing roller and at least one counter roller, in accordance with the present invention, has been set forth fully and completely hereinabove, it will be apparent to one of skill in the art that various changes could be made thereto, without departing from the true spirit and scope of the present invention, which is accordingly to be limited only by the appended claims.

The invention claimed is:

1. A method for determining the position of mutual contact between a printing roller (40) and at least one counter roller (30; 50), wherein the printing roller (40) and the counter roller (30; 50) to be placed in contact with said printing roller (40) are both arranged in a flexographic printing press (10), wherein the printing roller (40) is arranged between two counter rollers (30; 50), of which one counter roller (30) is in the form of a central drum (30) and the other counter roller (50) is in the form of an inking roller (50), wherein the printing roller (40) and both of the counter rollers (30; 50) to be placed in contact with said printing roller (40) each have a first electric motor (31; 41; 51) and can be moved in rotation, each by means of its respective first electric motor (31; 41; 51), wherein each of these first electric motors (31; 41; 51) has a first encoder (32; 42; 52), wherein at least the printing roller (40) and the inking roller (50) each have a second electric motor (43; 53) and can be moved translationally, each by means of its respective second electric motor (43; 53), in the direction (D) of a mutual approach between the printing roller (40) and the counter roller (30; 50) to be placed in contact with said printing roller (40), wherein each of these second electric motors (43; 53) has a second encoder (44; 54), and wherein the method comprises the following steps:

(a) moving the counter roller (30; 50) that is to be placed in contact with the printing roller (40) in rotation by means of its respective first electric motor (31; 51) while the printing roller (40), which is arranged spaced from said counter roller (30; 50), is left in a predetermined angular position and not rotating;

(b) moving the non-rotating printing roller (40) translationally in the direction D toward the counter roller (30; 50) that is to be placed in contact with the printing roller (40), by means of the corresponding second electric motor (43; 53);

(c) detecting at least one non-zero value of a parameter by means of the first encoder (42) of the corresponding first electric motor (41) of the printing roller (40), wherein this parameter indicates an idling rotation induced by the mutual contact between the counter roller (30; 50) that has been placed in contact with the printing roller (40) and the printing roller (40);

(d) determining the position of mutual contact between the printing roller (40) and the counter roller (30; 50) that has been placed in contact with the printing roller (40), based on the value of the detected parameter;

characterized by the following steps:

(e) changing the previous angular position of the printing roller (40) by a non-zero angle;

(f) repeating steps (a) to (d) and determining the corresponding position of mutual contact between the printing roller (40) and the counter roller (30; 50) that has been placed in contact with said printing roller (40) for the angular position of the printing roller (40) that was changed in step (e);

(g) calculating an average position of mutual contact between the printing roller (40) and the counter roller (30; 50) that has been placed in contact with said printing roller (40), on the basis of every position of mutual contact between the printing roller (40) and the counter roller (30; 50) that has been placed in contact with said printing roller (40), determined for a specific angular position of the printing roller (40), wherein the position of mutual contact between the printing roller (40) and the counter roller (30; 50) that has been placed in contact with said printing roller (40) is determined for each axial end of the printing roller (40) independently of the other end, and the average position of mutual contact between the printing roller (40) and the counter roller (30; 50) that has been placed in contact with said printing roller (40) is calculated for each axial end of the printing roller (40) independently of the other end.

2. The method according to claim 1, characterized in that each of the specified angular positions of the printing roller (40) is defined on the basis of a location in the relief of a cliche which is arranged on the lateral surface of the printing roller (40).

3. The method according to claim 1, characterized in that the determination of the position of mutual contact between the printing roller (40) and the counter roller (30; 50) to be placed in contact with said printing roller (40), which is carried out in step (d), comprises the following steps:

(d1) comparing the value of the detected parameter with a previously defined range of values for that parameter;

(d2) measuring the distance traveled by the printing roller (40) or by the counter roller (30; 50) to be placed in contact with said printing roller (40) in its respective translational movement up to the position of mutual contact between the printing roller (40) and the counter roller (30; 50) that has been placed in contact with said printing roller (40), by means of the second encoder (44; 54) of the second electric motor (43; 53) which drives the relevant translational movement;

(d3) determining the position of mutual contact between the printing roller (40) and the counter roller (30; 50) that has been placed in contact with said printing roller (40), based on the distance measured in step (d2), if the value of the detected parameter is within the previously defined value range for that parameter.

4. The method according to claim 1, characterized in that as the parameter to be detected according to step (c), an angular momentum of the printing roller (40) is detected, wherein this angular momentum is imparted to the printing roller (40) by the respective counter roller (30; 50).

5. The method according to claim 1, characterized in that the position of mutual contact between the printing roller (40) and the counter roller (30; 50) to be placed in contact with said printing roller (40) is determined by means of the respective second encoder (44, 54) of each second electric motor (43, 53), each independently of the other, when the printing roller (40) and the counter roller (30; 50) to be placed in contact with said printing roller (40) are moved translationally, each by its respective second electric motor (43; 53).

6. The method according to claim 1, characterized in that the calculated position of mutual contact between the printing roller (40) and the counter roller (30; 50) that has been placed in contact with said printing roller (40) is used in a printing process carried out by the flexographic printing press (10).

7. A flexographic printing press (10) comprising at least one printing roller (40) arranged between two counter rollers (30; 50), the one counter roller (30) being in the form of a central drum (30) and the other counter roller (50) being in the form of an inking roller (50), wherein the printing roller (40) and both of the counter rollers (30; 50) to be placed in contact with said printing roller (40) each have a first electric motor (31; 41; 51) and can be rotated, each by means of its respective first electric motor (31; 41; 51), wherein each of these first electric motors (31; 41; 51) has a first encoder (32; 42; 52), wherein at least the printing roller (40) and the inking roller (50) each have a second electric motor (43; 53) and can be moved translationally, each by means of its respective second electric motor (43; 53), in the direction (D) of a mutual approach between the printing roller (40)

and the counter roller (30; 50) to be placed in contact with said printing roller (40), wherein each of these second electric motors (43; 53) has a second encoder (44; 54), and wherein this flexographic printing press (10) is configured to carry out the steps of the method according to claim 1.

8. The flexographic printing press (10) according to claim 7, characterized in that a control unit (100) is provided and is configured such that this control unit (100) defines the specific angular positions of the printing roller (40) at the respective positions of mutual contact between the printing roller (40) and the counter roller (30; 50) to be placed in contact with said printing roller (40) and carries out a printing process using these defined angular positions of the printing roller (40).

* * * * *